US008253636B2

(12) United States Patent
Gardner et al.

(10) Patent No.: US 8,253,636 B2
(45) Date of Patent: Aug. 28, 2012

(54) IMPROVEMENTS RELATING TO ANTENNA ARRAYS

(75) Inventors: Peter Gardner, Birmingham (GB); Peter Scott Hall, Birmingham (GB); Ee Lee, Birmingham (GB); Teck Yiau Lee, Birmingham (GB); Bruno Pirollo, Maldon (GB); David Gunton, Colchester (GB)

(73) Assignee: Bae Systems PLC, London (GB)

( * ) Notice: Subject to any disclaimer, the term of this patent is extended or adjusted under 35 U.S.C. 154(b) by 149 days.

(21) Appl. No.: 12/094,507

(22) PCT Filed: Nov. 28, 2006

(86) PCT No.: PCT/GB2006/050418

§ 371 (c)(1),
(2), (4) Date: May 21, 2008

(87) PCT Pub. No.: WO2007/060487

PCT Pub. Date: May 31, 2007

(65) Prior Publication Data

US 2009/0046025 A1 Feb. 19, 2009

(30) Foreign Application Priority Data

Nov. 28, 2005 (EP) ..... 05270086
Nov. 28, 2005 (GB) ..... 0524176.5

(51) Int. Cl.
*H01Q 21/06* (2006.01)
*H01Q 1/32* (2006.01)

(52) U.S. Cl. ..... 343/711; 343/896; 343/702; 343/770; 343/771

(58) Field of Classification Search ..... 343/711, 343/700 MS, 702, 893, 770–771
See application file for complete search history.

(56) References Cited

U.S. PATENT DOCUMENTS 3,002,189 A 9/1961 Butler
3,302,207 A * 1/1967 Hoffman ..... 343/731
3,638,224 A 1/1972 Bailey et al.
3,696,433 A * 10/1972 Killion et al. ..... 343/770
(Continued)

FOREIGN PATENT DOCUMENTS

GB 739618 11/1955
(Continued)

OTHER PUBLICATIONS http://www.radio-electronics.com/info/antennas/waveguide/waveguide-basics-tutorial.php (Waveguide Basics Tutorial).*

(Continued)

*Primary Examiner* — Jacob Y Choi
*Assistant Examiner* — Amal Patel
(74) *Attorney, Agent, or Firm* — Buchanan Ingersoll & Rooney PC

(57) ABSTRACT

An improved antenna array (100) comprises a set of array elements (102 *a-p*) electromagnetically coupled to a transmission line. The transmission line comprises a live conductor (122) and a return conductor, and the live conductor (122) is terminated by a direct connection to the return conductor. An input signal fed to the live conductor (122) is radiated by the array elements (102 *a-p*) and the antenna array (100) is arranged such that any portion of the input signal reaching the termination is reflected at the termination so as to form a reflected signal that superimposes with the input signal to produce a predetermined farfield radiation pattern.

17 Claims, 5 Drawing Sheets

U.S. PATENT DOCUMENTS

| | | | | |
|---|---|---|---|---|
| 4,117,494 | A * | 9/1978 | Frazita | 343/844 |
| 4,313,120 | A * | 1/1982 | Westerman | 343/771 |
| 4,409,595 | A | 10/1983 | Park et al. | |
| 4,429,313 | A * | 1/1984 | Muhs et al. | 343/771 |
| 6,429,825 | B1 * | 8/2002 | Martek | 343/770 |
| 6,771,222 | B1 * | 8/2004 | Rosenbaum | 343/700 MS |
| 2006/0091982 | A1 * | 5/2006 | Berg | 333/236 |

FOREIGN PATENT DOCUMENTS

| | | | |
|---|---|---|---|
| GB | 1220395 | A | 1/1971 |
| GB | 1431243 | A | 4/1976 |
| GB | 2235336 | A | 6/1990 |
| WO | WO 2004/070877 | A1 | 8/2004 |

OTHER PUBLICATIONS

Mckinzie III et al., "A Microstrip-Fed Log-Periodic Slot Array" Digest of the Antennas and Propagation Society International Symposium, 1994, vol. 3, pp. 1278-1281.

Pirollo et al., "Future Antenna Technologies for Cars and Trucks" VehCom Conference, 2003, 6 pages.

Sakakibara et al., "A Linearly-Polarized Slotted Waveguide Array Using Reflection-Cancelling Slot Pairs" IEICE Trans. Commun., 1994, vol. E77-B, No. 4, pp. 511-517.

EPO, GB and International Search Reports, Mar. 26, 2006 (EPO), Feb. 3, 2006 (GB) and Jan. 24, 2007 (International).

* cited by examiner

IMPROVEMENTS RELATING TO ANTENNA ARRAYS

This invention relates to improvements to antenna arrays. More particularly, this invention relates to improvements to antenna arrays for microwave and millimeter-wave communications, in the frequency range 2-300 GHz.

Transmission-line fed linear antenna arrays are well known in the art of antenna design. Such antenna arrays comprise a transmission line, and a set of radiating array elements that are coupled to the transmission line, thereby removing and radiating energy from the line. Arrays can be arranged so that the energy of an input signal is radiated as it moves along the line. Such arrays are known as travelling-wave arrays. In currently-known travelling-wave arrays, the line is terminated by a matched load that prevents reflections back down the line towards the input. Normally the matched load is a resistor. By choosing the relative phases of the energy radiated at each array element, the direction of the beam can be controlled. The phase distribution can be controlled by introducing meanders into the transmission line so to as to introduce the necessary phase delays.

Known examples of such antenna arrays include microwave and millimeter-wave patch antenna arrays using air-spaced rectangular cross-section coaxial lines. Microwave and millimeter-wave passive components are also known. Also known are antenna arrays comprising radiating slots fed by waveguides, transmission line or slow wave structures. The need for resistive termination to prevent reflecting back down the line is disclosed, for example, in B. Pirollo, R. A Lewis, P. Gardner, G. Ma, T. Y. Lee, P. S. Hall, D. Pansegrouw and K. Davies, "Future Antenna Technologies for Cars and Trucks," VehCom Conference, June 2003, Birmingham.

Such antenna arrays find application in, amongst other fields, the development of intelligent road networks to improve road safety and traffic flow. These networks require vehicle-to-beacon and vehicle-to-vehicle communication. The 63-64 GHz band has been designated for use in such road-transport communication applications by the European Conference on Postal and Telecommunications Administrations (CEPT). This band is particularly suited to such networks, since it has the potential for large capacity, wide bandwidth data links. A further feature of this band is that it lies within the oxygen absorption band, thus limiting the maximum communication range available and thereby allowing frequency re-use schemes to be employed.

A number of problems, however, exist with currently-known antenna arrays that prevent their effective use in such applications. A particular problem with conventional transmission-line fed antenna arrays is that dielectric supports, resistive layers, materials and/or output connectors are required to support the transmission line inner conductor. The conventional resistive termination is not mechanically robust, and is not therefore able to provide sufficient mechanical support for the central conductor. Additional components complicate the manufacturing process, whereas a simple manufacturing process is essential if antenna arrays are to be cheaply and widely used in, for example, a road-side communication network. Furthermore, dissipation of the input signal energy is wasteful and leads to inefficiency, reducing the range over which the antenna array is able to communicate. Whilst a reduced range has the benefit of allowing frequency re-use schemes to operate, the range must be sufficiently large to allow practical and economic antenna spacing.

According to a first aspect of the present invention, there is provided an antenna array comprising a set of array elements electromagnetically coupled to a transmission line; which transmission line comprises a live conductor and a return conductor, the live conductor extending between a feed operable to receive an input signal, and a termination, which termination is a direct connection of the live conductor to the return conductor, such that a portion of the input signal is reflected at the termination to form a reflected signal; wherein the antenna array is configured such that the input signal and the reflected signal superimpose to produce a predetermined far-field radiation pattern.

The direct connection of the live conductor to the return conductor to terminate the transmission line is contrary to the established practice, in the design of travelling-wave series-fed antenna arrays operating at millimeter-wave or microwave frequencies, of using a resistive termination for the transmission line. Preferably, the antenna array is a travelling-wave series-fed antenna array. The termination of the transmission line by direct connection of the live conductor to the return conductor is referred to as a reactive termination, to distinguish the direct connection from the resistive termination used in prior-known arrays. It is to be understood that the term "direct connection" is used herein to mean a connection that is both electrically and mechanically direct. The use of a reactive termination, in accordance with embodiments of the present invention, is advantageous in that no energy is dissipated at the termination, thus creating a more efficient antenna array. In embodiments of the present invention, the portion of the input signal that is, in prior-known antenna arrays, dissipated at a resistive termination, is instead reflected at the reactive termination and usefully radiated to contribute to the far-field radiation pattern. The configuration of the antenna array is chosen such that the reflected signal has an appropriate phase and amplitude to superimpose onto the first-pass input signal so as to form the desired far-field radiation pattern.

The term "first pass" when used herein is intended to refer to that part of the input signal that produces the same results as would be achieved were a matched load present at the termination, instead of the reactive termination. The term "reflected signal" is used to refer to the remaining part of the input signal, that is reflected back along the live conductor by the reactive termination.

The direct connection of the live conductor to the return conductor at the termination of the live conductor furthermore provides a robust mechanical support for the live conductor. An additional support is provided at the feed by the connection of feed means to the live conductor. The feed means provide a mechanism for an electromagnetic signal to be input to the antenna array. The connection between the feed means and the live conductor may, for example, comprise a transmission line stub. Advantageously, the robust mechanical support provided at the termination of the live conductor by the direct connection of the live conductor to the return conductor is sufficient, in combination with the additional mechanical support provided by the connection of the feed means to the live conductor, to completely support the live conductor. In addition, the supporting transmission line stub could be used as a part of an impedance matching network when required.

The live conductor may comprise a radiating part and a non-radiating end part, and the length of the end part is configured such that the input signal and the reflected signal superimpose to produce a predetermined far-field radiation pattern. Conveniently, the phase of the reflected signal relative to the input signal can be chosen simply by altering the length of the end part of the live conductor. By choosing an appropriate phase relationship between the input signal and the reflected signal, a desired radiation pattern can be achieved.

Optionally, the degree of electromagnetic coupling between the set of radiating elements and the transmission line is configured such that the reflected signal consists of less than 30% of the input signal energy. Preferably, the degree of electromagnetic coupling between the set of radiating elements and the transmission line is configured such that the reflected signal consists of less than 20% of the input signal energy. More preferably, the degree of electromagnetic coupling between the set of radiating elements and the transmission line is configured such that the reflected signal consists of less than 10% of the input signal energy. The degree of electromagnetic coupling can be chosen, for example, by altering the number of array elements in the set of array elements. It has been found that a desired radiation pattern is more readily achievable when the reflected signal consists of less than 30% of the input signal energy, still more readily achievable when the reflected signal consists of less than 20% of the input signal energy, and yet more readily achievable when the reflected signal consists of less than 10% of the reflected signal energy.

Preferably, the termination is provided on an end wall formed in the return conductor. Such configurations result in an advantageously simple construction for the antenna array. It is possible, where necessary, to provide additional mechanical support to the live conductor at intervals along its length by connecting it to the return conductor using transmission line stubs. The length of these stubs is chosen such that the electromagnetic path length along them is one quarter of the wavelength of the radiation to be emitted by the antenna array. Preferably, however, the live conductor is suspended between the feed and the termination. Advantageously, by suspending the live conductor between its termination and its feed, any need for additional lossy dielectric supports is obviated, thereby improving the efficiency of the antenna array.

Preferably, at other than the point of termination, the return conductor is air-spaced from the live conductor. The transmission line is then an air-spaced transmission line. Air-spaced transmission lines exhibit low losses in the microwave and millimeter-wave bands. Antenna arrays according to embodiments of the invention are particularly suited to operation in these bands.

The set of radiating elements may comprise at least one set of slots formed in the return conductor. In preferred embodiments, the antenna array comprises an air-spaced transmission line in which the radiating elements are provided by slots in the return conductor. The antenna array then takes a particularly simple form, such that the manufacture of antenna arrays according to the invention can be achieved at low cost.

The return conductor may comprise an enclosure at least partially surrounding the live conductor. The return conductor then advantageously serves also to protect the live conductor from environmental damage. Such protection is particularly useful in embodiments in which the live conductor is fabricated from a thin strip of metal, and is therefore susceptible to environmental damage. Preferably, the enclosure is of rectangular cross-section, thus further reducing the cost and complexity of the manufacture of antennas according to embodiments of the invention.

Optionally, the set of array elements comprises a first set of slots formed in a first surface of the enclosure and a second set of slots formed in a second surface of the enclosure. Embodiments of the invention comprising first and second sets of slots are able to radiate beams in different directions simultaneously. For example, such embodiments may be able to radiate beams in both a forward and a backward direction. The ability to radiate beams in both a forward and a backward direction is expected to be advantageous for antennas used in roadside communications networks, enabling one antenna array to communicate with road vehicles ahead of it, and to the rear of it.

Preferably, the return conductor comprises first and second conducting layers, and the live conductor is formed in an intermediate conducting layer sandwiched between the first and second conducting layers. Conveniently, the intermediate conducting layer can thus be made in a single manufacturing step, for example by etching, which manufacturing step also provides the live conductor. An outer part of the intermediate conducting layer may form part of the return conductor. Since the live conductor can thus be formed integrally with part of the return conductor, a mechanically robust connection between the live conductor and the return conductor can be ensured.

Optionally, the set of array elements and the live conductor are formed in a single conducting layer. This advantageously reduces the number of manufacturing steps required to fabricate the antenna, since fewer layers are needed. The return conductor may also be formed in the single conducting layer. The antenna array then requires only one conducting layer, further reducing the number of manufacturing steps required, and thus reducing the cost of manufacture of the antenna.

The invention extends to vehicles comprising antenna arrays as described above, for use in communications applications associated with the vehicle. Further, the present invention extends to road-side communication networks comprising antenna arrays as described above, for use in communications with passing or stationary vehicles.

The above and further features of the invention are set forth in the appended claims and will be explained in detail in the following with reference to various exemplary embodiments and to the accompanying drawings in which:

Figure 1:
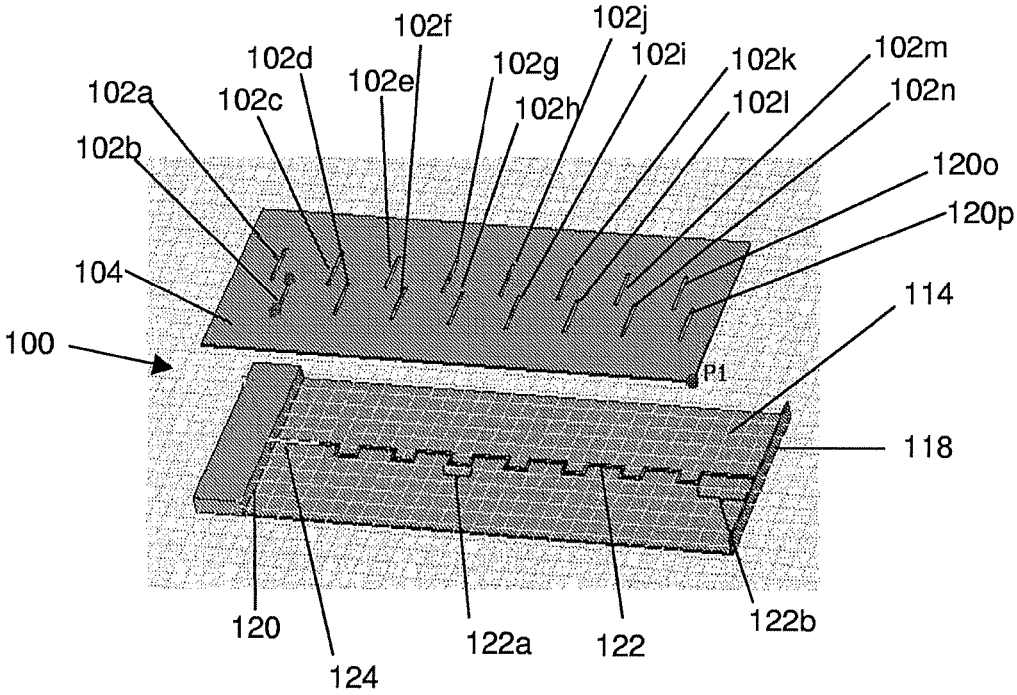
FIG. 1 is a schematic view of an antenna array according to a first embodiment of the invention.
Figure 3A:
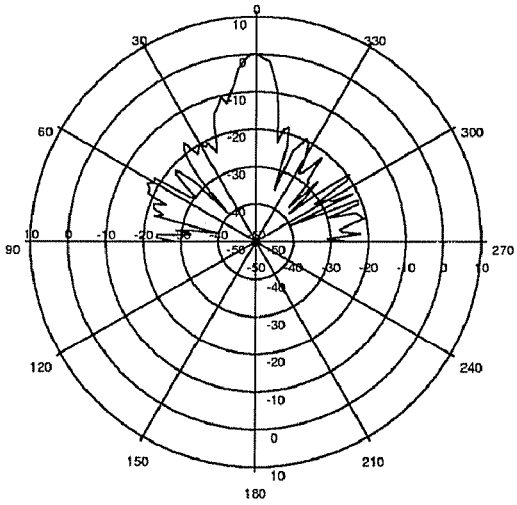
Figure 3B:
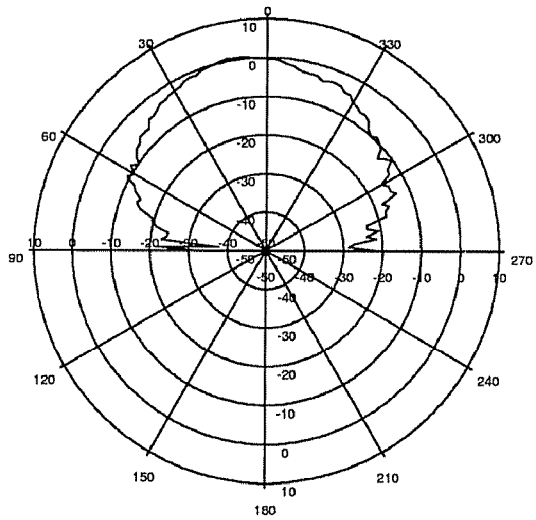
Figure 4:
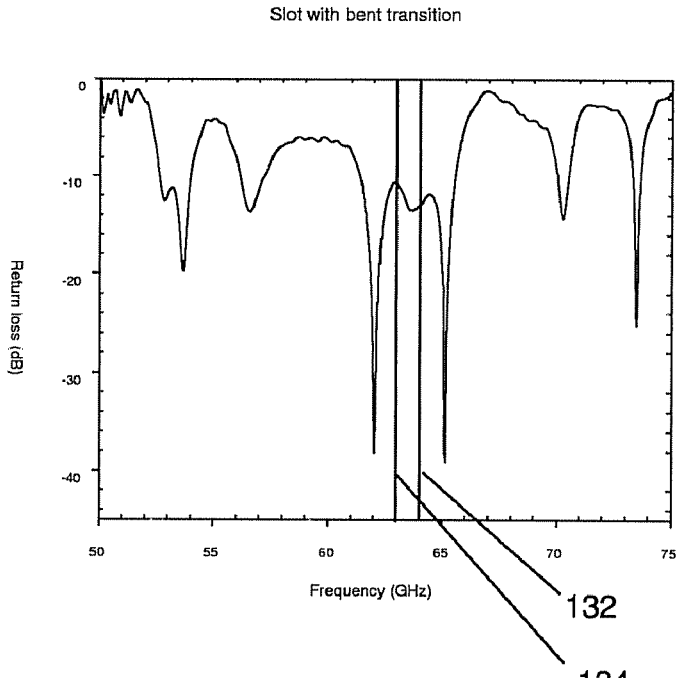
Figure 5A:
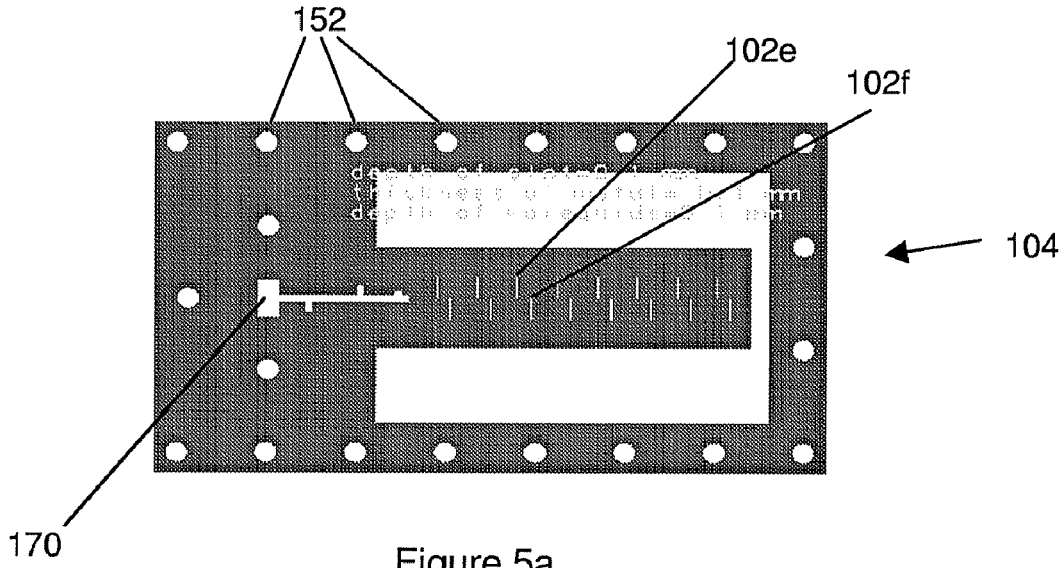
Figure 5B:
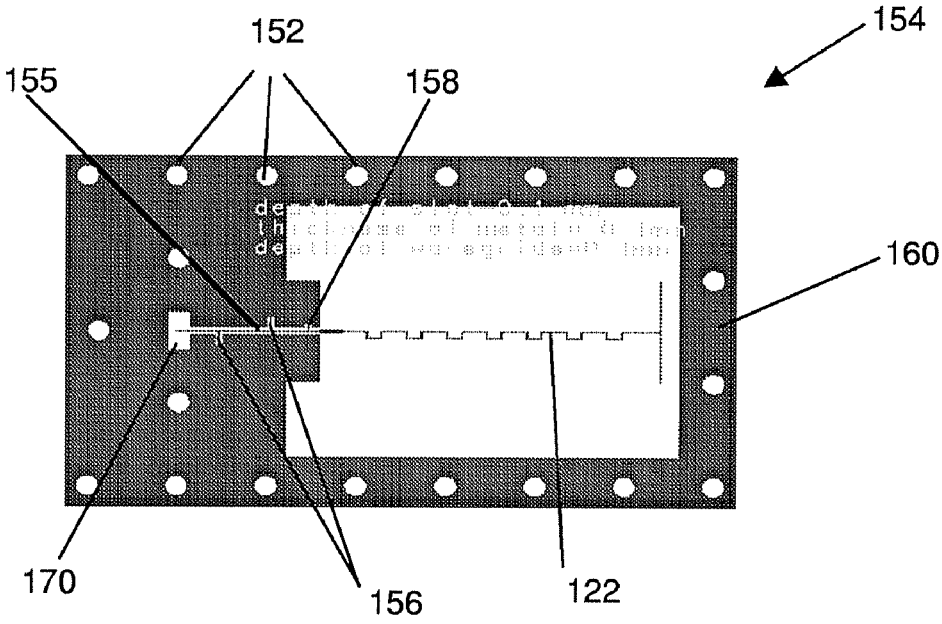
Figure 6:
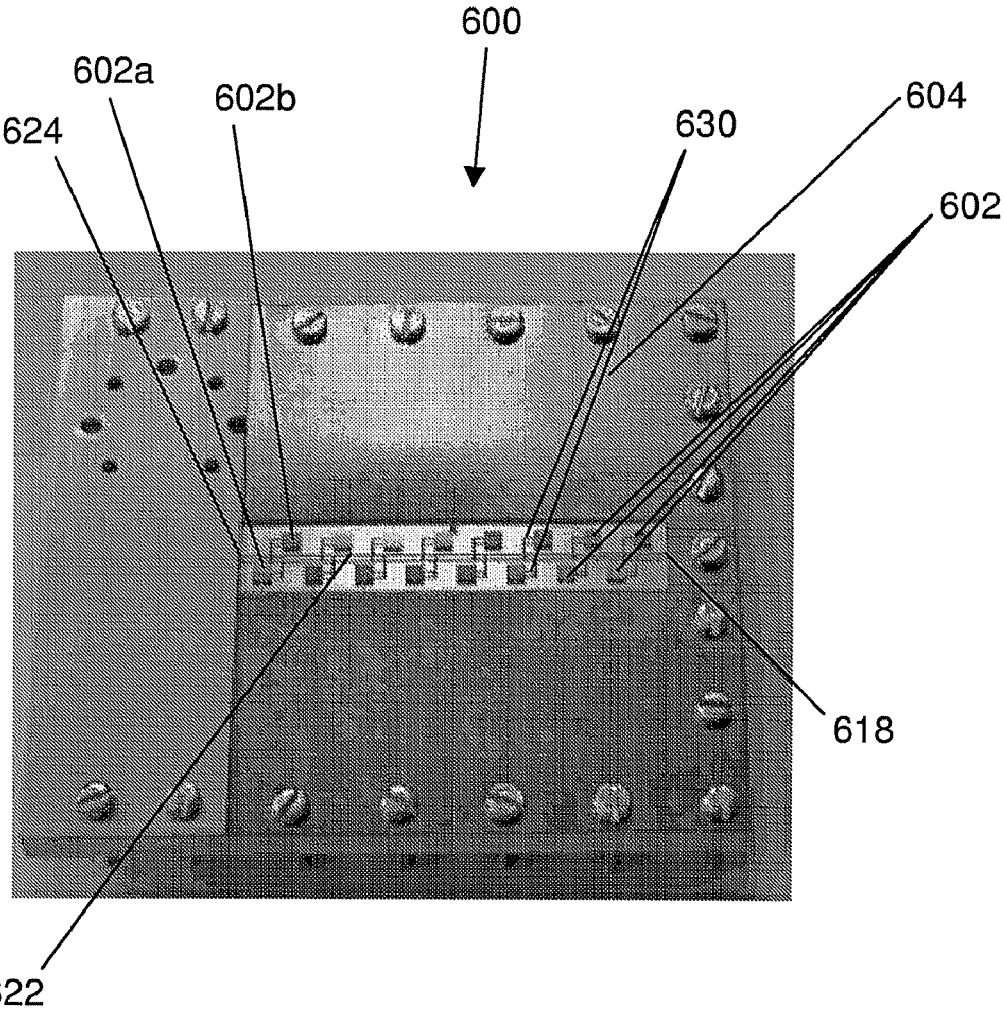
Figure 7:
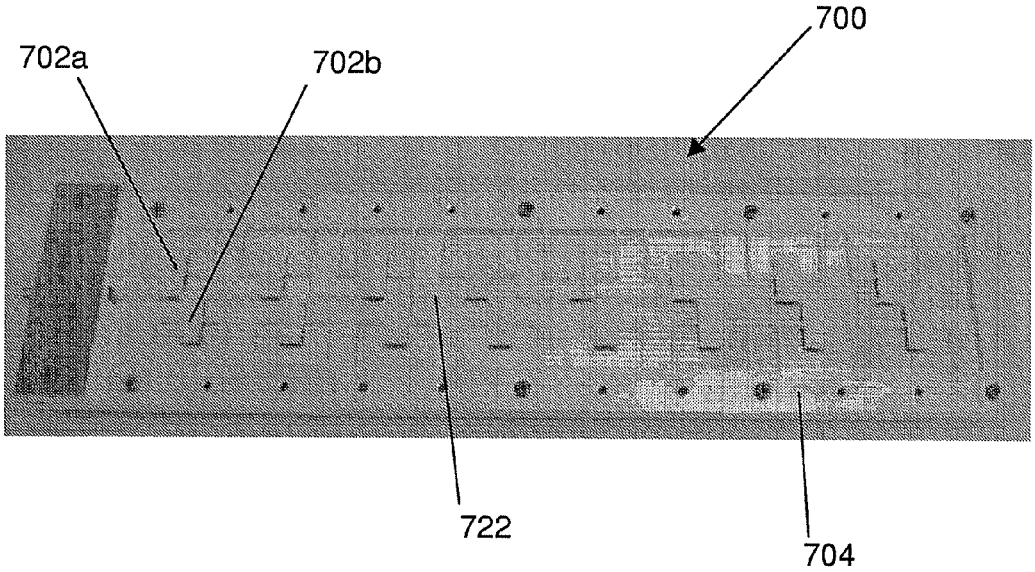
Figure 8:
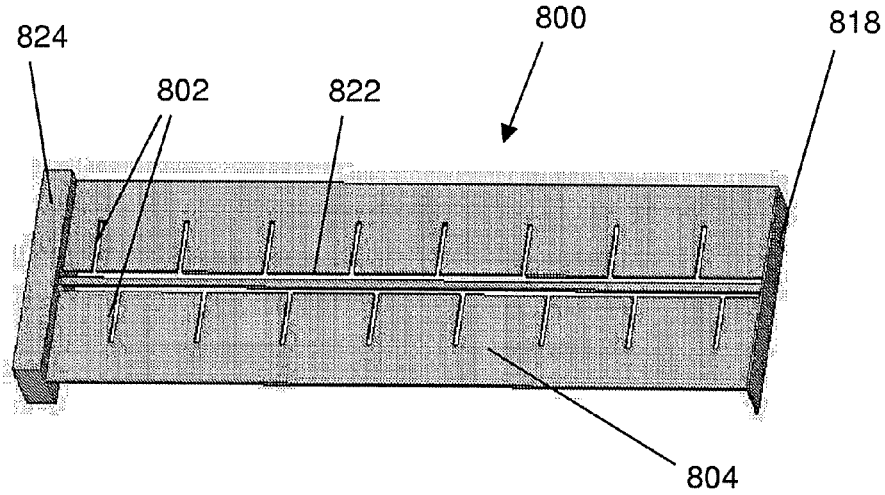

FIGS. 3*a* and 3*b* are graphs representing the measured radiation patterns of the antenna array of FIG. 1;

FIG. 4 is a graph representing the measured return loss of the antenna array of FIG. 1;

FIG. 5*a* is a plan view of the top layer of the antenna array of FIG. 1;

FIG. 5*b* is a plan view of an intermediate layer of the antenna array of FIG. 1;

FIG. 6 is a photograph of an antenna array according to a second embodiment of the invention;

FIG. 7 is a photograph of an antenna array according to a third embodiment of the invention; and FIG. 8 is a schematic view of an antenna array according to a fourth embodiment of the invention.

FIG. 1 illustrates schematically an antenna array 100 according to a first embodiment of the present invention. Antenna array 100 comprises a square co-axial transmission line having live conductor 122, and a return conductor formed by a conducting enclosure housing the live conductor. The conducting enclosure is defined by upper surface 104, lower surface 114, and walls 118 and 120, and side walls (not shown). Note that, in the view shown in FIG. 1, upper surface 104 is lifted away from the rest of antenna array 100 such that the interior of the antenna array 100 can be illustrated. The return conductor is connected to ground. Slots 102 *a-p*, provided in the upper surface 104 of the antenna array 100, are the array elements of antenna array 100. Thus, an input signal fed to the transmission line propagates along live conductor 122 and, at each slot, a portion of the input signal energy is reflected, a portion is radiated, and a portion is transmitted. The transmitted portion continues to propagate along live conductor 122.

Slots 102*a-p* are grouped in pairs 102*a,b*; 102*c,d*; 102*e,f*; 102*g,h*; 102*i,j*, 102*k,l*; 102*m,n*; 102*o,p*. The slots 102*a-p* are slightly offset from a centre line of the upper surface 104 of antenna 100, with each pair having one slot offset to one side of the centre line, and the other slot offset to the other side of the centre line.

The length of the slots 102*a-p* is half the wavelength of radiation at the resonant frequency of antenna array 100. Thus the resonant frequency of the antenna array 100 can be chosen by altering the length of slots 102*a-p*. For a resonant frequency of 63.5 GHz, wavelength is 4.72 mm and slots 102*a-p* are 2.36 mm long. The slot pairs 102*a,b*; 102*c,d*; 102*e,f*; 102*g,h*; 102*i,j*; 102*k,l*; 102*m,n* and 102*o,p* are separated by a distance of approximately 0.7λ (where λ is the wavelength of radiation at the resonant frequency of antenna array 100) corresponding to 3.57 mm for the antenna array 100 shown. This separation is chosen in order to minimise the possibility of unwanted grating lobes in the radiation pattern produced by antenna array 100. The separation of slots within each pair is approximately λ/4, corresponding to 1.19 mm for the antenna array shown. Thus slots 102*a* and 102*b* are separated by 1.19 mm, slots 102*c* and 102*d* are separated by 1.19 mm, and slots 102*a* and 102*c* are separated by 3.57 mm. The separation of λ/4 is chosen so as to minimise the effect of reflections of part of the input signal in the live conductor from each individual slot 102*a-p*. Radiation reflected from slot 102*b*, for example, is in antiphase to incident radiation at slot 102*a*, because there is a half wavelength path difference between incident and reflected radiation. Slot pairs such as pair 102*a,b* can therefore be viewed as single radiating elements, and the term "radiating element" will be used hereinafter to refer to such slot pairs.

Live conductor 122 is not straight, but contains a number of meanders such as that indicated at 122*a*, so that the live conductor 122 appears castellated. These meanders ensure that the transmission line length between the radiating elements is λ, and thus that the radiating elements radiate in phase. In-phase radiation is required for a broadside beam to be emitted by the antenna array. Of course, the same effect would be achieved by any transmission line length equivalent to an integer number of wavelengths, as will be well understood by those skilled in the art.

Live conductor 122 runs between end walls 118 and 120, and is spaced from the surfaces of the enclosure formed by upper surface 104, lower surface 114, walls 118 and 120, and side walls (not shown in FIG. 1) by air gaps. The thickness of the air gaps between the upper and lower surfaces 104 and 114 and live conductor 122 is determined by the desired characteristic impedance of the antenna array 100. Antenna array 100 has characteristic impedance 100Ω and the air gaps between upper and lower surfaces 104 and 114 and live conductor 122 are 0.7 mm wide.

At end wall 120, live conductor 122 is supported and fed by transmission line stub 124. At the opposite end wall 118, live conductor 122 is reactively terminated by direct connection to the return conductor of the transmission line, at the conducting plane formed by end wall 118. This direct connection confers two distinct advantages on antenna array 100. Firstly, antenna array 100 is more efficient, since none of the input energy is dissipated in a resistive termination that, in prior known antenna arrays, can waste of order 5-10% of the input energy. Secondly, directly connecting the inner conductor 122 to the end wall provides a good mechanical support for inner conductor 122, thereby obviating the need for additional lossy dielectric supports to be included. Together with transmission-line stub 124, the direct connection of live conductor 122 at end wall 118 provides sufficient mechanical support for the live conductor.

Due to the direct termination of live conductor 122, a small signal is reflected at the termination of the transmission line, at the end wall 118 of the enclosure. Prior to the invention, a resistive termination was used to terminate transmission lines in order to dissipate this reflected signal, such that the reflected signal would not interfere with the input (and therefore the radiated) signal. However, the design of antenna array 100 accounts for this reflected energy, and allows the reflected energy to be usefully radiated. This is achieved by modelling of the radiation pattern of the antenna array 100 during the design process. By appropriate choice of the antenna array design parameters during the design process, the amplitude and phase of the reflected energy can be controlled. For example, parameters such as the degree of electromagnetic coupling between the array elements and the live conductor, and the length of the part of the live conductor between the last of the array elements and the termination (the end part of the live conductor, indicated at 122*b* in FIG. 2), can be varied in response to modelling results.

The degree of electromagnetic coupling between the array elements and the live conductor is chosen so that a large proportion of the input signal energy is radiated on a first pass of the input signal along the live conductor. As the input signal propagates along the live conductor, at each array element, a portion of the input signal energy is radiated, a portion is transmitted, and a portion is reflected. The effect of inter-element reflections is substantially reduced by the λ/4 spacing between the two array elements in each radiating element, but there may still be some remnant effect. The term "first pass" when used herein is intended to include all such interactions: i.e., the "first pass" of the input signal produces the same results as would be achieved were a matched load present at the termination. In antenna array 100, approximately 90% of the input signal is radiated on the first pass of the input signal.

The remaining part of the input signal is reflected at the termination provided by the direct connection of the live conductor 122 to end wall 118. The term "reflected signal" is used to refer to this part of the input signal, that is reflected from the termination at 118. By choosing the degree of electromagnetic coupling to ensure that a large proportion of the input signal is radiated on the first pass of the input signal, it is further ensured that the reflected signal is only a comparatively small addition to the output far-field radiation pattern. This small addition is simpler to account for during the design process. The phase of the reflected signal relative to the first pass input signal can be adjusted by altering the length of the end part 122*b* of the live conductor near the end wall 118. The relative phase of these two signals affects the far-field superposition of their respective radiation patterns, and is chosen using computer modelling techniques such that the two signals superimpose to produce the desired output radiation pattern.

Figure 2:
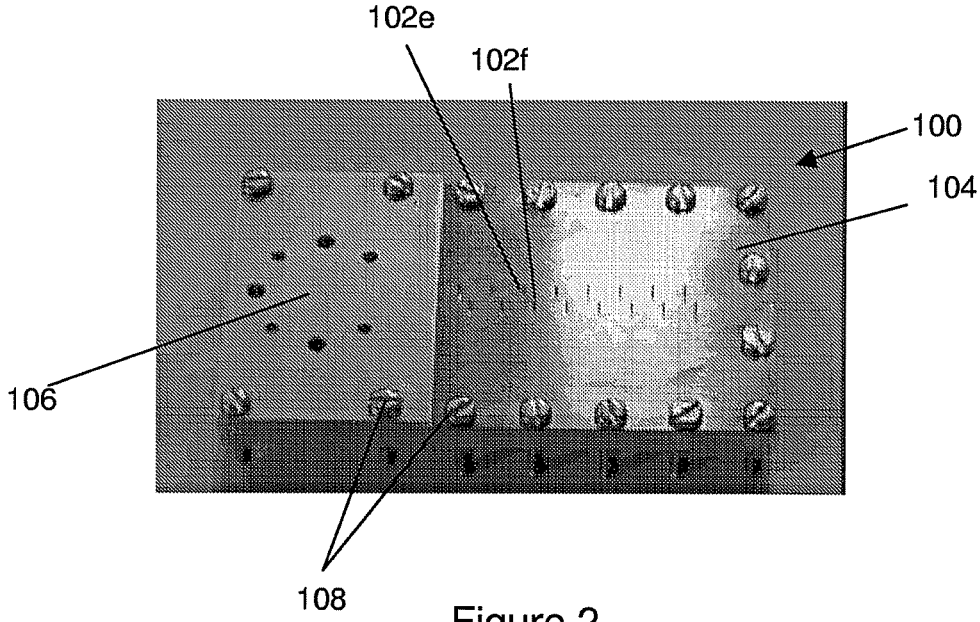
FIG. 2 is a photograph of the antenna array illustrated schematically in FIG. 1.

FIG. 2 is a photograph of the antenna array 100 illustrated schematically in FIG. 1. Slots 102 *a-p* are visible in upper surface 104 of the antenna array, whilst interior features such as live conductor 122 are not visible. Note that, for clarity, only slots 102 *e,f* have been labelled. The input for the antenna array is structure 106 (not shown in FIG. 1), which structure 106 is a waveguide to square co-axial line connector. Also shown in FIG. 2 are screws, such as those labelled 108, around the perimeter of the upper surface 104 of antenna array 100. It is important for screws 108 to tightly fasten the enclosure together, so as to prevent radiation leakage at the joins between the component parts of the antenna 100, and so as to form a good electrical connection between the component parts of the return conductor. Construction of the enclosure is described further hereinafter.

FIGS. 3*a* and 3*b* show the co-polarisation pattern for the E and H plane respectively for the antenna array 100 shown in FIGS. 1 and 2. These graphs demonstrate that the direct termination is successfully incorporated into the design of antenna array 100. In particular, FIGS. 3*a* and 3*b* show that the narrow radiation beam is formed by antenna array 100 in one dimension, through the action of the array factor. FIG. 4 is a graph illustrating how the measured return loss of the antenna array 100 shown in FIGS. 1 and 2 varies with input frequency. The graph demonstrates that a good return loss value (approximately −12 dB) is achieved over the operating bandwidth of 63 GHz to 64 GHz, despite the use of a direct termination. The good return loss value indicates that good input matching has been achieved.

To construct antenna array 100, upper layer 104 and an intermediate conducting layer providing live conductor 122 are etched from metal sheets. The metal sheets are approximately 0.1 mm thick. FIGS. 5*a* and 5*b* show the as-etched metal layer details for upper layer 104 and middle layer 154 respectively. Visible around the perimeter of the conducting layer 104 are holes 152 for screws 118 shown in FIG. 1. Also visible are slots 102*a-p* that form the radiating elements of antenna array 100. FIG. 5*b* shows an intermediate conducting layer 154 of the antenna array in which the live conductor 122 is formed. As can be seen, live conductor 122 is formed as an integral part of layer 154. The outer part of conducting layer 154, indicated by reference numeral 160, does not form part of live conductor 122 but is in fact part of the return conductor of the transmission line. Only a single etching step is thus needed to wholly fabricate middle conducting layer 154, thereby simplifying the manufacturing of antenna array 100 since additional manufacturing steps for the fabrication of, for example, lossy dielectric supports or a resistive termination, are not required. It is noted that this method of construction leads naturally to a robust connection between the live conductor 122 and the return conductor, since the live conductor 122 is formed integrally with a part of the return conductor. FIG. 5*b* also illustrates holes 152 for screws 108 (shown in FIG. 1), and feed 155 to inner conductor 122. Feed 155 is supported by means of quarter wavelength stubs 156. These sections are transparent to an input signal because of their chosen length. Section 158 is used as part of the matching circuit for the antenna array. Also visible, in both FIGS. 5*a* and 5*b*, is a rectangular hole 170 for the waveguide input to antenna 100.

Thus, to construct antenna array 100, conducting layers 104 and 154 are etched as described above. The remaining parts, including a conducting spacer part to fit between layers 104 and 154, and a bottom part 126, are milled from aluminium. The conducting spacer provides the upper portion of the walls of the enclosure forming the return conductor of the transmission line. The bottom part provides the lower portion of the walls of this enclosure, and also provides lower surface 114 illustrated schematically in FIG. 2. These aluminium parts also comprise a number of holes suitable for receiving screws 108 as shown in FIG. 1. Construction of antenna array 100 is completed by the step of fastening together the bottom aluminium part 126, the intermediate etched conducting layer 154, the spacer aluminium part 125, and the top etched conducting layer 104, using screws 108. The step of fastening thus forms the enclosure surrounding the live conductor 122. The return conductor is formed by top conducting layer 104, aluminium spacer part 125 and bottom part 126, and also by the outer part 160 of intermediate conducting layer 154, which is clamped between aluminium parts 125 and 126 by screws 108.

FIG. 6 shows an antenna array 600 according to a second embodiment of the invention. Antenna array 600 is similar to antenna array 100 described above, but for the use of patch antenna elements 602, instead of slots, to provide the set of array elements in the case of antenna array 600. As with slots 102*a-p* illustrated in FIG. 1, patch array elements 602 are grouped in pairs, as indicated for elements 602*a,b*. Live conductor 622 is, in this embodiment, co-planar with the patch array elements 602. No meanders are present in live conductor 622, in contrast to live conductor 122 of antenna array 100. It was found by experiment that no grating lobes were formed by the antenna array 600 in the absence of meanders in live conductor 622. It is thought that the absence of grating lobes is due to the array elements 602 having different individual radiation patterns to those of elements 102 of antenna array 100. The patch elements 602 are connected to live conductor 622 by quarter-wavelength stubs, such as stub 630*a,b* that connect elements 602*a,b* to live conductor 622. Live conductor 622 is terminated by direct connection to the return conductor formed by upper surface 604 of antenna array 600 at end 618 opposite feed 624. Notably, the return conductor is also co-planar with live conductor 622. As with antenna array 100, the direct connection of the live conductor 622 to the return conductor 604 creates a more mechanically robust, and more efficient antenna array.

FIG. 7 shows an antenna array 700 according to a third embodiment of the invention. Antenna array 700 is very similar to antenna array 600 shown in FIG. 6. However, in antenna array 700, the patch elements 702 extend directly from the live conductor 722, obviating the need for stubs to connect the array elements to the live conductor. Again, it was found by experiment that meanders were not necessary in live conductor 722.

FIG. 8 shows an antenna array 800 according to a fourth embodiment of the invention. Antenna array 800 represents a modification of antenna array 100 shown in FIG. 1. Antenna array 800 comprises live conductor 822, return conductor 804 and array elements provided by slots, such as slots 802. Again, it was found by experiment that meanders were not necessary in live conductor 822. The live conductor extends from a feed at 824 to a terminations at end wall 818, at which the live conductor 822 is directly connected to the return conductor. However, in this embodiment, the live conductor 822, radiating elements 802 and return conductor 804 are all provided in the same conducting layer. By forming all these component parts in a single conducting layer, a simpler construction process is enabled.

Various equivalents and modifications to the above-described exemplary embodiments are possible without departing from the scope of the invention, as will be readily understood by those skilled in the art. For example, antenna array 100 shown in FIG. 1 forms a beam in one direction only. In order to create a beam in the opposite direction as well, it is possible to include further radiating elements on the bottom layer of the antenna array, similar to the array of slots 102 *a-p* illustrated in FIGS. 1, 2, 5*a* and 5*b*. Such a modification would require an additional etched metal layer, similar to metal layer 104, to replace the aluminium bottom described above. A spacer aluminium part would then separate the bottom layer from the middle layer. The inclusion of additional array elements on the underside of the antenna array would alter the loading of the transmission line, and would require the antenna design to be modified in order to account for the different line loading. Furthermore, whilst in the antenna array 100 described above is fastened together using screws, it may also be possible to weld or otherwise fasten the structure together. It may also be possible to fabricate the live conductor as a patterned conductor on a thin dielectric sheet, instead of etching the live conductor as described above. Such a fabrication method is expected to be advantageous where the live conductor is particularly fragile and requires extra support, such as when the live conductor is formed only of a particularly thin strip of metal. Furthermore, such a fabrication method makes use of techniques well-known to those skilled in the art. Clearly, it is also possible to vary the number of array elements in the antenna array. Having regard to the above description, such modifications will be obvious to those skilled in the art, and will not be described further.

It is to be appreciated that the inventive concept of the reactive termination by direct connection of the live conductor to the return conductor is of broad applicability to travelling-wave series-fed antennas operating at millimeter-wave or microwave frequencies. The above described embodiments illustrate that this concept can be applied to both air-spaced slot and patch antenna array designs. The inventive concept can also, for example, be applied to air-spaced patch antenna array elements coupled to a reactively terminated feed line via apparatus in an intervening ground plane. Furthermore, dipole antenna arrays may, according to embodiments of the invention, be coupled to a suspended, reactively-terminated feed line. Dielectric resonator antenna arrays, coupled reactively to a suspended, reactively-terminated feed line are also envisaged. The invention may further be applied to beam-shaping by means of profiling the coupling factors between the suspended, reactively-terminated feed line and the different array elements. Two-dimensional arrays, formed by parallel combinations of one-dimensional arrays, may also be constructed in accordance with embodiments of the invention. Each one-dimensional array in such an embodiment can be fed by a reactively-terminated feed line, which feed line is in turn fed by a beam-forming network such as a Butler matrix, or a corporate feed network.

The above embodiments are to be understood as illustrative examples of the invention. Further embodiments are envisaged. It is to be understood that any feature described in relation to any one embodiment may be used alone, or in combination with other features described, and may also be used in combination with one or more features of any of the other embodiments, or any combination of any of the other embodiments. Furthermore, equivalents and modifications not described above may also be employed without departing from the scope of the invention, which is defined in the accompanying claims.

The invention claimed is:

1. A traveling-wave series-fed antenna array comprising:

a set of radiating elements electromagnetically coupled to a transmission line; which transmission line comprises a live conductor and a return conductor, the live conductor extending between a feed operable to receive an input signal; and a termination, which termination is a direct connection of the live conductor to the return conductor, such that a portion of the input signal is reflected at the termination to form a reflected signal, wherein the live conductor is supported by the termination and the feed, wherein the return conductor includes a first conducting layer and a second conducting layer, and the live conductor is formed in an intermediate conducting layer sandwiched between and spaced-apart from the upper return conductor and the lower return conductor, the return conductor thereby forming an enclosure at least partially surrounding the live conductor, wherein each radiating element comprises a pair of slots, the first slot being offset to one side of the return conductor center line, the second slot being offset to the other side of the return conductor center line, wherein the first slot and the second slot are separated by a predetermined factor of a wavelength, and wherein the pair of slots are arranged perpendicular or transverse to the return conductor center line, wherein the live conductor includes meanders and is configured such that the length of the live conductor between radiating elements is generally equal to a predetermined factor of a wavelength, and wherein the antenna array is configured such that the input signal and the reflected signal superimpose to produce a predetermined far-field radiation pattern.

2. The antenna array as claimed in claim 1 wherein the live conductor comprises a radiating part and a non-radiating end part, and the length of the end part is configured such that the input signal and the reflected signal superimpose to produce a predetermined far-field radiation pattern.

3. The antenna array as claimed in claim 1 wherein the degree of electromagnetic coupling between the set of radiating elements and the transmission line is configured such that the reflected signal consists of less than 30% of the input signal energy.

4. The antenna array as claimed in claim 1 wherein the degree of electromagnetic coupling between the set of radiating elements and the transmission line is configured such that the reflected signal consists of less than 20% of the input signal energy.

5. The antenna array as claimed in claim 1 wherein the degree of electromagnetic coupling between the set of radiating elements and the transmission line is configured such that the reflected signal consists of less than 10% of the input signal energy.

6. The antenna array as claimed in claim 1 wherein the termination is provided on an end wall formed in the return conductor.

7. The antenna array as claimed in claim 1 wherein the live conductor is suspended between the feed and the termination.

8. The antenna array as claimed in claim 1 wherein the return conductor is air-spaced from the live conductor.

9. The antenna array as claimed in claim 1 wherein the enclosure is of rectangular cross-section.

10. The antenna array as claimed in claim 1 wherein the set of radiating elements comprises a first set of slots are formed in a first surface of the enclosure and a second set of slots formed in a second surface of the enclosure.

11. The antenna array as claimed in claim 1, wherein the transmission line length between the radiating elements is such that, in use, the radiating elements radiate in phase.

12. The antenna array as claimed in claim 1, wherein the termination is non-radiative.

13. The antenna array as claimed in claim 1, wherein the first slot and the second slot are separated by a quarter of a wavelength.

14. The antenna array as claimed in claim 1 wherein the length of live conductor between radiating elements is generally equal to the wavelength.

15. A vehicle comprising a traveling-wave series-fed antenna array comprising:

a set of radiating elements electromagnetically coupled to a transmission line; which transmission line comprises a live conductor and a return conductor, the live conductor extending between a feed operable to receive an input signal and a termination, which termination is a direct connection of the live conductor to the return conductor, such that a portion of the input signal is reflected at the termination to form a reflected signal, wherein the live conductor is supported by the termination and the feed, wherein the return conductor comprises a first conducting layer and a second conducting layer, and the live conductor is formed in an intermediate conducting layer sandwiched between and spaced-apart from the upper return conductor and the lower return conductor, the return conductor thereby forming an enclosure at least partially surrounding the live conductor, wherein the set of radiating elements comprises at least one set of slots formed in the return conductor, a first slot of the set being offset to one side of the return conductor center line, a second slot of the set being offset to the other side of the return conductor center line, wherein the set of slots are arranged perpendicular or transverse to the return conductor center line, wherein the live conductor comprises meanders and as such is configured such that the length of live conductor between radiating elements is generally equal to a predetermined factor of a wavelength, and wherein the antenna array is configured such that the input signal and the reflected signal superimpose to produce a predetermined far-field radiation pattern.

16. A road-side communication network comprising:

a traveling-wave series-fed antenna array comprising a set of radiating elements electromagnetically coupled to a transmission line; which transmission line comprises a live conductor and a return conductor, the live conductor extending between a feed operable to receive an input signal and a termination, which termination is a direct connection of the live conductor to the return conductor, such that a portion of the input signal is reflected at the termination to form a reflected signal, wherein the live conductor is supported by the termination and the feed, wherein the return conductor comprises a first conducting layer and a second conducting layer, and the live conductor is formed in an intermediate conducting layer sandwiched between and spaced-apart from the upper return conductor and the lower return conductor, the return conductor thereby forming an enclosure at least partially surrounding the live conductor, wherein the set of radiating elements comprises at least one set of slots formed in the return conductor, a first slot of the set being offset to one side of the return conductor center line, a second slot of the set being offset to the other side of the return conductor center line, wherein the set of slots are arranged perpendicular or transverse to the return conductor center line, wherein the live conductor comprises meanders and as such is configured such that the length of live conductor between radiating elements is generally equal to a predetermined factor of a wavelength, and wherein the antenna array is configured such that the input signal and the reflected signal superimpose to produce a predetermined far-field radiation pattern.

17. A traveling-wave series-fed antenna array comprising:

a set of radiating elements electromagnetically coupled to a transmission line; which transmission line comprises a live conductor and a return conductor, the live conductor extending between a feed operable to receive an input signal and a termination, which termination is a direct connection of the live conductor to the return conductor, such that a portion of the input signal is reflected at the termination to form a reflected signal, wherein the live conductor is supported by the termination and the feed, wherein the return conductor comprises a first conducting layer and a second conducting layer, and the live conductor is formed in an intermediate conducting layer sandwiched between and spaced-apart from the upper return conductor and the lower return conductor, the return conductor thereby forming an enclosure at least partially surrounding the live conductor, wherein the set of radiating elements comprises at least one a pair of slots formed in the return conductor, the first slot being offset to one side of the return conductor center line, the second slot being offset to the other side of the return conductor center line, wherein the pair of slots are arranged perpendicular or transverse to the return conductor center line, wherein the live conductor is configured such that the length of live conductor between radiating elements is generally equal to a predetermined factor of a wavelength, and wherein the antenna array is configured such that the input signal and the reflected signal superimpose to produce a predetermined far-field radiation pattern.

* * * * *